United States Patent [19]

Slaughter

[11] Patent Number: 4,848,812

[45] Date of Patent: Jul. 18, 1989

[54] CONCEALED SAFETY LOCK

[76] Inventor: Steven J. Slaughter, 1930 California St., San Diego, Calif. 92101

[21] Appl. No.: 179,320

[22] Filed: Apr. 8, 1988

[51] Int. Cl.[4] ..... F05C 19/16

[52] U.S. Cl. ..... 292/144; 292/251.5; 70/276

[58] Field of Search ..... 292/251.5, 144; 70/276, 70/413, 289; 220/230

[56] References Cited

U.S. PATENT DOCUMENTS

| | | | |
|---|---|---|---|
| 2,730,392 | 1/1956 | Thiebaud | 70/287 |
| 3,584,485 | 6/1971 | Peterson | 70/276 |
| 3,596,958 | 8/1971 | Bowerman | 292/201 |
| 3,600,019 | 8/1971 | Toyota | 70/276 |
| 3,641,793 | 2/1972 | Van Dalen | 70/276 |
| 3,736,779 | 6/1973 | Pratt | 70/276 |
| 3,744,833 | 7/1973 | Berdulone | 292/251.5 |
| 3,831,986 | 8/1974 | Kobayashi | 292/251.5 |
| 3,837,195 | 9/1974 | Pelto | 70/413 |
| 3,837,525 | 9/1974 | Kobayashi | 70/276 |

FOREIGN PATENT DOCUMENTS

| | | | |
|---|---|---|---|
| 73446 | 8/1949 | Denmark | 70/276 |
| 1036702 | 8/1958 | Fed. Rep. of Germany | 70/413 |
| 1201160 | 8/1970 | United Kingdom | 70/413 |
| 1580850 | 12/1980 | United Kingdom | 292/251.5 |
| 2145461 | 3/1985 | United Kingdom | 292/251.5 |
| 2182713 | 5/1987 | United Kingdom | 292/341.16 |

*Primary Examiner*—Gary L. Smith
*Assistant Examiner*—Eric K. Nicholson
*Attorney, Agent, or Firm*—Brown, Martin, Haller & McClain

[57] ABSTRACT

A device for selectively locking a door in a closed position against a door frame member having a body with a substantially planar mounting surface for engaging the face of the door and a throughbore in the body substantially parallel to the mounting surface. A mounting mechanism included for coupling the body to the door. A magnetic bolt is disposed within the throughbore for slidable movement between a retracted position and an extended position wherein a portion of the bolt extends outwardly from the body when in the extended position. A retainer is included for limiting the travel of the bolt between the retracted and extended positions. A striker is mounted to the door frame member for engaging the bolt in the extended position so as to secure the door against the door frame member in the closed position.

19 Claims, 1 Drawing Sheet

CONCEALED SAFETY LOCK

BACKGROUND OF THE INVENTION

I. Field of the Invention

The present invention relates to safety locks for doors. More specifically, the present invention relates to a novel and improved safety lock for mounting upon the inside of a cabinet door for selectively locking the door in a closed position against a door frame member by use of magnetic forces.

II. Description of the Related Art

In the home environment where small children are present, certain safety procedures are often recommended. Among them is the recommendation that cabinets in which dangerous chemicals, substances and equipment are stored be restricted from access by the children, so as to prevent accidental poisoning or other injuries. Many various attempts have been made to provide a child-proof device to secure cabinet doors in a closed position.

Conventional cabinetry found in the home enviroment typically includes doors mounted upon stiles with the doors including handles to facilitate opening and closing. Cabinet handles are known to come in many various shapes or forms. One method of securing or "child-proofing" the cabinet doors is by using the conventional strap or loop type devices that attach to the door handles. However, many types of handle styles are incompatible with these types of locking devices. This is especially true where the cabinet doors have no handles but use a gripping ledge as a handle for opening and closing purposes.

Previously known safety locks have traditionally been mounted upon the exterior of the cabinet. In certain cabinet styles, it is preferred that any type of lock mechanism be concealed from view to prevent spoiling of the aesthetic appearance of the cabinetry.

In order to maintain the aesthetic appearance of the cabinets, several locks have been devised for mounting upon the inside of the cabinetry. The hidden or concealed locks, due to their hidden nature, provide better protection than visually apparent locks. One type of the concealed lock requires modification of the cabinet door to permit a lock release mechanism to protrude through the door itself. However, this type of lock may detract from the overall appearance of the cabinetry. Another type of concealed lock requires that the door be partially opened to disengage the locking of the door. As a result, partial entry may be sufficient to cause harm to the individual, if access can be made to the contents inside the cabinet. Furthermore, viewing of the opening procedure by a child may be sufficient for him or her to repeat the procedure when left unattended.

It is, therefore, an object of the present invention to provide a novel and improved concealed lock mechanism for securing a door in a closed position against a door frame member.

SUMMARY OF THE INVENTION

The present invention is a novel and improved safety lock for selectively locking a door in a closed position against a door frame member. The lock includes a body having a substantially planar mounting surface for engaging the face of a door and also a throughbore substantially parallel to the mounting surface. Means are included for coupling the body to the door while a magnetic bolt is disposed within the throughbore for slidable movement between a retracted position and an extended position. When in the extended position, a portion of the bolt extends outwardly from the body. Retainer means is included for limiting the travel of the bolt between the retracted and extended positions. The lock further includes striker means for mounting to the door frame member for engaging the bolt when in the extended position so as to secure the door against the door frame member in a closed position.

The body is mounted typically to the inside face of the door while the striker means is correspondingly mounted to the door frame member interior of the cabinet structure. A magnet key is positioned adjacent the outside face of the door in a region surrounding the location of the lock so as to magnetically engage and disengage the bolt from the striker means.

BRIEF DESCRIPTION OF THE DRAWINGS

These and other features, objects, and advantages of the present invention will become more fully apparent from the detailed descriptions set forth below when taken in conjunction with the drawings in which like reference characters identify correspondingly throughout and wherein.

DETAILED DESCRIPTION OF THE PREFERRED EMBODIMENTS

Figure 1:
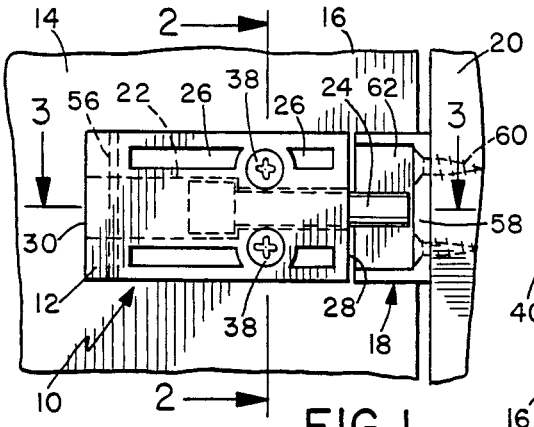
FIG. 1 is a side elevation view of the lock of the present invention mounted upon a door and associated door frame.

Referring now to FIG. 1, illustrated therein is lock assembly 10 which includes a rectangular box-shaped body 12 adapted for mounting upon the inside surface 14 of cabinet door 16 and a striker 18 mounted upon cabinet frame member 20. Assembly 10 includes in body 12 cylindrical throughbore 22 in which a cylindrical bolt 24 is disposed.

Body 12 is typically formed from a non-magnetic material such as ABS plastic by injection molding or milling techniques. In injection molding it is preferable to reduce the ultimate amount of material required to fabricate body 12. Therefore, as illustrated in FIG. 1, portions 26 are removed from the region adjacent throughbore 22. Bolt 24 positioned within throughbore 22 is typically an alnico magnet.

Figure 2:
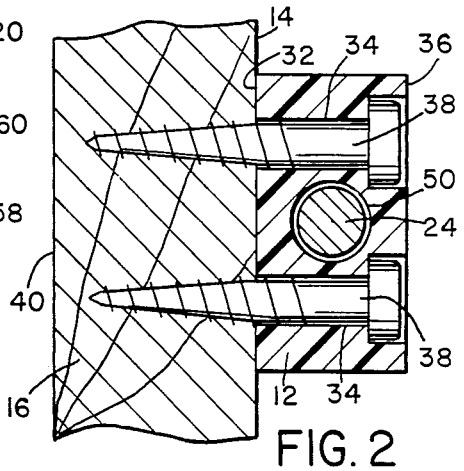
FIG. 2 is an enlarged sectional view taken on line 2—2 of FIG. 1.

Referring to FIGS. 1 and 2, body 12 is formed with throughbore 22 extending the length of body 12 between body ends 28 and 30 and centered about a lateral axis. Body 12 has a substantially planar mounting surface 32 for positioning against door inside surface 14. Throughbore 22 is also substantially parallel to mounting surface 32. Body 12 includes a pair of mounting holes 34 which perpendicularly extend through body 12 from surface 36, opposite mounting surface 32, to mounting surface 32. Mounting holes 34 are typically formed in body 12 spaced apart on opposite sides of throughbore 20 and intermediate of body ends 28 and 30. Mounting holes 34 may be countersunk adjacent surface 36 for receiving the heads of screws 38 which are positioned in a respective one of mounting holes 34. Screws 38 are typically fabricated from a magneto-metallic material to permit conduction of magnetic fields. The threads of screws 38 engage door 16 from surface 14 and extend therein a distance sufficient such that a magnet positioned on outside surface 40 of door 16 would be conducted by screws 38 to move bolt 24 within throughbore 22. It is preferred that when body 12 is mounted to door 16, throughbore 22 be in a substantially horizontal position.

Figure 3:
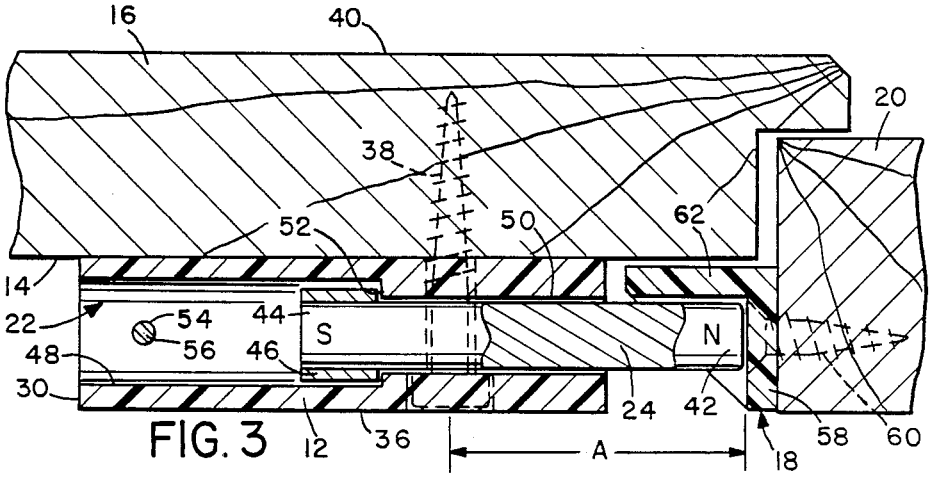
FIG. 3 is an enlarged sectional view taken on line 3—3 of FIG. 1.
Figure 4:
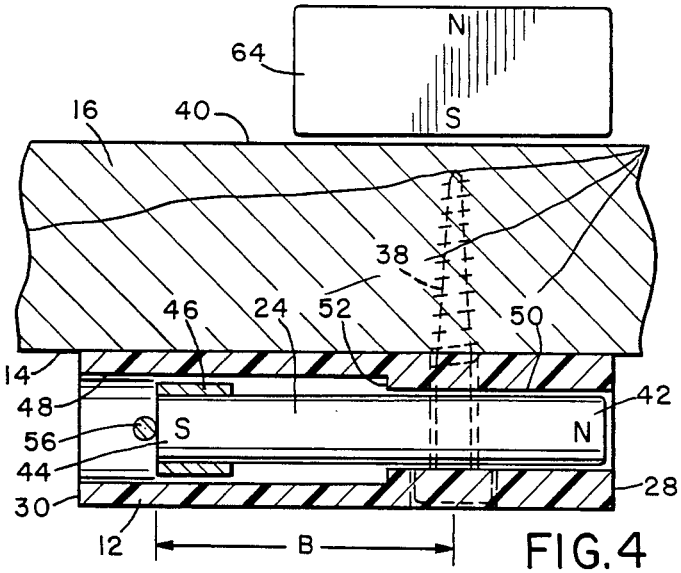
FIG. 4 is a view similar to FIG. 3, with the bolt retracted by application of a magnet.

Referring now to FIGS. 3 and 4, body 12 is mounted upon door 16 as previously described. In FIG. 3, magnetic bolt 24 is positioned in an extended position similar to that illustrated in FIG. 1. In the extended position, a portion of bolt 24 adjacent bolt end 42 extends beyond end 28 of body 12, body end 28 facing striker 18. At the opposite end of bolt 24, bolt end 44, is mounted sleeve 46. Sleeve 46 acts in combination with throughbore 22 as a means for limiting the axial travel of bolt 24 towards striker 18.

Throughbore 22 is formed with an enlarged cross-sectional throughbore portion 48 extending a length from body end 30 towards mounting holes 34. Throughbore 22 is formed with a smaller dimensional cross-sectional throughbore portion 50 extending from body end 28 beyond mounting holes 34. The intersection of throughbore portions 48 and 50 form shoulder 52. Sleeve 46 abutts against shoulder 52 to restrict the travel of bolt 24 beyond the extended position.

Body 12 may further include a hole 54 which is formed so as to perpendicularly extend into throughbore 22. A metallic pin 56 is positioned in hole 54. Pin 56 provides a means for restricting the travel of bolt 24 within throughbore 22 to prevent bolt 24 from exiting throughbore 22 at body end 30.

FIG. 4 illustrates bolt 24 in a retracted position. In the retracted position, bolt 24 does not protrude beyond body end 30. In addition, bolt end 44 may be magnetically attracted to pin 56 to assist in holding bolt 24 in the retracted position, depending upon the composition of pin 56. Pin 56 may be either formed from a non-magnetic material such as aluminum or plastic, or from a magnetic metal such as steel or any other ferric material.

With reference to FIGS. 3 and 4, it is preferred that body 12 be mounted in a specific location to achieve optimum performance. With regard to FIG. 3, a dimension A is indicated as being the distance from the center of screw 38 to bolt end 42 of bolt 24 when bolt 24 is in the extended position. Referring to FIG. 4, when bolt 24 is in the retracted position, the distance between the center of screw 38 and bolt end 44 is labeled as dimension B. It is preferred that the dimension A equal that of dimension B. This particular arrangement of the screws positioned adjacent the throughbore, in conjunction with the dimensional standards for the bolt in the retracted and extended positions with respect to the screws, provides a unique feature to the invention. It is discovered that when the dimension A equals that of dimension B the bolt experiences a "springy" condition when in either the retracted or extended position. For example, when the bolt is in the extended position, the application of a slight inward force applied to the bolt is repulsed. Upon removal of this inward force, provided it was insufficient to force the bolt into the retracted position, the bolt springs outwardly to the original extended position. This action is also experienced when a similar outward force is applied to the bolt when in the retracted position. This spring action provides a unique resiliency for the bolt to change from one position to another without application of a force sufficient to overcome the magnetic forces of the bolt upon the screws. In normal placement of the lock assembly, shaking of the door or cabinet will not overcome this spring force to change the position of the lock.

Referring to FIG. 3, striker 18 is formed in an L-shaped configuration with leg 58 affixed by screw 60 to frame member 20. The other leg or land 62 to striker 18 is perpendicular to leg 58 and engages the portion of bolt 24 adjacent bolt end 44. Striker 18 is preferably made from a durable, rigid, non-magnetic material such as aluminum or plastic. In the alternative, a hole may be bored into frame member 20 for receiving bolt 24 in the extended position.

The magnetic field of magnet key 64 when positioned in the region adjacent lock assembly 10 adjacent the door outside face 40 influences the magnetic field of bolt 24. The magnetic field of magnet 64 is conducted by screws 38 to force travel of bolt 24 in throughbore 22. The conductance of the magnetic field by screws 38 in combination with the magnetic field of bolt 24 forces bolt 24 to slide within throughbore 22 depending upon the polarity position of the respective magnets 64 and 24. In FIGS. 3 and 4, bolt ends 42 and 44 are respectively illustrated as being magnetic North (N) and South (S) poles. It should be understood that the specific pole position may be reversed if desired.

In a preferred embodiment such as illustrated in FIGS. 1–4, body 12 may be constructed having a length from end 28 to end 30 of 1.75 inches, a thickness measured between mounting surface 32 and surface 36 of 0.5 inches and a height of approximately 0.95 inches. Throughbore portion 50 is typically a cylindrical bore of 0.30 inches in diameter while throughbore portion 48 is also a cylindrical bore of 0.39 inches in diameter. Magnet 24 is typically an alnico magnet having a diameter preferably in the range of 0.1875–0.25 inches, and a length of 1.375 inch. Screws 34 are typically steel screws either 1.00 or 1.25 inches long and sufficient to penetrate into wood or other non-metallic material cabinet doors respectively 0.75 or 1.00 inches thick. Sleeve 46 is typically a tube-shaped member formed of aluminum, plastic or nylon.

Figure 5:
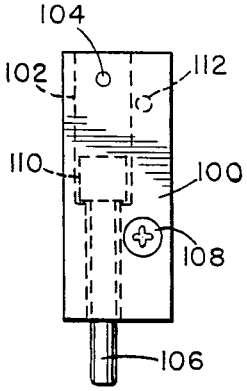
FIG. 5 is a side elevational view of an alternative body configuration of the lock of the present invention.

FIG. 5 illustrates an alternate embodiment of the present invention. The embodiment as illustrated in FIG. 5 is configured for mounting upon either a cabinet door or a drawer. Body 100 is of a construction similar to that of body 12 in FIGS. 1–4. Body 100 includes a throughbore 102 similar to that of throughbore 22 and has enlarged and smaller throughbore portions. The configuration illustrated in FIG. 5 enables the lock to work with throughbore 102 in a vertical position. Pin 104 magnetically attracts bolt 106 when in the retracted position to prevent it from falling into the extended position, the extended position illustrated in FIG. 5. It is preferred that pin 104 be formed from a metallic material such as steel or any other ferric material. Body 100 includes a mounting hole (not shown) into which a single mounting screw 108 is positioned to affix body 100 to a door or drawer. Bolt 106 may further include a retaining sleeve 110 which functions in a manner similar to that as discussed with reference to sleeve 46 of FIGS. 1–4. Body 100 may further include a protrusion 112 which protrudes from the mounting surface of body 100. Protrusion 112 engages a preformed hole or a dimple in the inside surface of the door or drawer to prevent rotation of body 100 when affixed by screw 108 to the door or drawer.

The previous description of the preferred embodiments are provided to enable any person skilled in the art to make or use the present invention. Various modifications to these embodiments will be readily apparent to those skilled in the art, and the generic principles defined herein may be applied to other embodiments without the use of the inventive faculty. Thus, the present invention is not intended to be limited to the embodiments shown herein, but is to be accorded the widest scope consistent with the principles and novel features disclosed herein.

I claim:

1. A safety lock, responsive to the magnetic field of a magnetic key for selectively locking or unlocking a door from a door frame member, comprising:

a body having a substantially planar mounting surface for engaging a face of said door and a throughbore in said body substantially parallel to said mounting surface;

mounting means for coupling said body to said door, said mounting means having at least one magnetic conductive member each disposed within said body adjacent said throughbore;

a magnetic bolt disposed within said throughbore for slidable movement between a retracted position and an extended position wherein a portion of said bolt extends outwardly from said body when in said extended position, said bolt for engaging said door frame member when in said extended position and wherein each magnetic conductive member is disposed in said body at a location according to the relationship where a first distance is that being from each conductive member to one end of said bolt adjacent said door frame member, when said bolt is in said extended position, is substantially equal to a second distance being from each conductive member to an other end of said bolt when said bolt is in said retracted position, said bolt when in one of said retracted and extended positions responsive to the application of a magnetic field of a magnetic key, conducted to said bolt by at least one conductive member, by changing to the other one of said retracted and extended positions and remaining in said other one of said retracted and extended positions upon removal of the magnetic field; and retainer means for limiting the travel of said bolt between said retracted and extended positions.

2. The lock of claim 1 wherein said mounting means comprises;

at least one mounting hole formed in said body adjacent said throughbore and extending through said body substantially perpendicular to said mounting surface; and a mounting screw forming said magnetic conductive member for disposing within each mounting hole.

3. The lock of claim 1 wherein said mounting means comprises:

at least one pair of mounting holes each formed in said body on opposite sides of throughbore and extending through said body substantially perpendicular to said mounting surface; and a plurality of mounting screws each forming a respective magnetic conductive member and each for disposing within a respective mounting hole.

4. The lock of claim 2 wherein each mounting screw is formed of a magneto-metallic material and penetrates into said door a distance sufficient to be conductive to a magnet positioned on an opposite side of said door.

5. The lock of claim 3 wherein each mounting screw is formed of a magneto-metallic material and penetrates into said door a distance sufficient to be conductive to a magnet positioned on an opposite side of said door.

6. The lock of claim 1 wherein said retainer means comprises:

a predetermined length of said throughbore having an enlarged cross-section extending from a position intermediate of ends of said body between which said throughbore extends and one of said ends facing away from said door frame member;

a bolt slide limiter disposed upon said bolt within said enlarged cross-section length of said throughbore.

7. The lock of claim 6 further comprising stop means mounted upon said body adjacent said body end facing away from said door frame member for restricting the travel of said bolt in said body to said retracted position substantially within said body when moved from said extended position.

8. The lock of claim 7 wherein said stop means comprises a retainer member disposed within said said throughbore enlarged cross-sectional length adjacent said end of said body facing away from said door frame member.

9. The lock of claim 1 wherein said retainer means comprises:

said throughbore having a first cross-sectional dimension for a predetermined length through said body adjacent an end of said body facing said door frame member and a second cross-sectional dimension for a predetermined length through said body adjacent an opposite end of said body, said second cross-sectional dimension greater than said first cross-sectional dimension so as to form a shoulder at the intersection of said first and second cross-sectional lengths of said throughbore; and a bolt slide limiter disposed upon said bolt within said second cross-sectional length of said throughbore.

10. The lock of claim 9 further comprising stop means mounted upon said body adjacent said body opposite end for restricting the travel of said bolt within said body to said retracted position when moved from said extended position.

11. The lock of claim 10 wherein said stop means comprises a retainer member disposed within said second cross-sectional length of said throughbore adjacent said body opposite end.

12. A safety lock assembly for selectively locking a door in a closed position against a door frame member, comprising:

a body formed of a non-magnetic material having a mounting surface for engaging an inside face of said door with a throughbore formed in said body parallel to said door inside face, said throughbore having an opening facing said door frame member;

a pair of mounting holes, said pair of mounting holes formed in said body on opposite sides of said throughbore and extending through said body substantially perpendicular to said door inside face;

a pair of mounting screws each for disposing within a respective mounting hole for securing said body to said door inside face, each mounting screw formed of a magneto-metallic material and penetrates into said door a distance sufficient to be conductive to a magnet positioned on an outside face of said door opposite said door inside face;

a magnetic bolt disposed within said throughbore for slidable movement between a retracted position and an extended position wherein a portion of said bolt extends outwardly from said body when in said extended position, and wherein a first distance being from said mounting screws to one end of said bolt adjacent said striker plate when said bolt is in said extended position is equal to a second distance being from said mounting screws to an other end of said bolt when said bolt is in said retracted position;

retainer means for limiting the travel of said bolt between said retracted and extended positions; and a striker plate formed of a non-magnetic material for affixing to a door frame member, said plate having a land for engaging said portion of said bolt when said bolt is in said extended position.

13. The lock assembly of claim 12 wherein said retainer means comprises:

said throughbore having a first cross-sectional dimension for a predetermined length through said body adjacent an end of said body facing said striker means and a second cross-sectional dimension for a predetermined length through said body adjacent an opposite end of said body, said second cross-sectional dimension greater than said first cross-sectional dimension so as to form a shoulder at the intersection of said first and second cross-sectional lengths of said throughbore;

a bolt slide limiter disposed upon said bolt within said second cross-sectional length of said throughbore; and a retainer member formed of a magneto-metallic material disposed within said second cross-sectional length of said throughbore adjacent said body opposite end.

14. The lock assembly of claim 12 further comprising a magnet key for positioning adjacent an outer face of said door in a region about said body for selectively sliding said bolt by magnetic force.

15. A safety lock assembly for selectively locking a door in a closed position against a door frame member, comprising:

a body formed of a non-magnetic material having a mounting surface for engaging an inside face of said door with a throughbore formed in said body parallel to said door inside face, said throughbore having an opening facing said door frame member;

a mounting hole formed in said body extending through said body substantially perpendicular to said door inside face;

a mounting screw for disposing within said mounting hole for securing said body to said door inside face, said mounting screw formed of a magneto-metallic material and penetrates into said door a distance sufficient to be conductive to a magnet positioned on an outside face of said door opposite said door inside face;

a magnetic bolt disposed within said throughbore for slidable movement between a retracted position and an extended position wherein a portion of said bolt extends outwardly from said body when in said extended position, and wherein a first distance being from said mounting screw to one end of said bolt adjacent said striker plate when said bolt is in said extended position is equal to a second distance being from said screw to an other end of said bolt when said bolt is in said retracted position;

retainer means for limiting the travel of said bolt between said retracted and extended positions; and a striker plate formed of a non-magnetic material for affixing to a door frame member, said plate having a land for engaging said portion of said bolt when in said extended position.

16. The lock assembly of claim 15 wherein said retainer means comprises:

said throughbore having a first cross-sectional dimension for a predetermined length through said body adjacent an end of said body facing said striker means and a second cross-sectional dimension for a predetermined length through said body adjacent an opposite end of said body, said second cross-sectional dimension greater than said first cross-sectional dimension so as to form a shoulder at the intersection of said first and second cross-sectional lengths of said throughbore;

a bolt slide limiter disposed upon said bolt within said second cross-sectional length of said throughbore; and a retainer member formed of a magneto-metallic material disposed within said second cross-sectional length of said throughbore adjacent said body opposite end.

17. The lock assembly of claim 15 further comprising a magnet for positioning adjacent an outer face of said door in a region about said body for selectively sliding said bolt by magnetic force.

18. The lock of claim 1 further comprising striker means for mounting to said door frame member for engaging said bolt in said extended position so as to secure said door against said door frame member.

19. The lock of claim 18 wherein said striker means comprises an L-shaped plate having one leg affixed to said door frame and another leg extending towards said body so as to engage said bolt portion when said bolt is in said extended position.

* * * * *

UNITED STATES PATENT AND TRADEMARK OFFICE

CERTIFICATE OF CORRECTION

PATENT NO. : 4,848,812

DATED : July 18, 1989

INVENTOR(S) : Steven J. Slaughter

It is certified that error appears in the above-identified patent and that said Letters Patent is hereby corrected as shown below:

Column 6, Claim 6, line 14, after "one of said"

insert --body--;

Signed and Sealed this

Second Day of October, 1990

*Attest:*

HARRY F. MANBECK, JR.

*Attesting Officer*

*Commissioner of Patents and Trademarks*